United States Patent [19]

Fister, Jr. et al.

[11] 4,113,472

[45] Sep. 12, 1978

[54] HIGH STRENGTH ALUMINUM EXTRUSION ALLOY

[75] Inventors: Julius C. Fister, Jr., Hamden; John F. Breedis, Trumbull; Michael J. Pryor, Woodbridge, all of Conn.

[73] Assignee: Swiss Aluminium Ltd., Chippis, Switzerland

[21] Appl. No.: 784,155

[22] Filed: Apr. 4, 1977

[51] Int. Cl.[2] ..... C22C 21/16

[52] U.S. Cl. ..... 75/142; 148/2; 148/11.5 A; 148/12.7 A; 148/32; 148/32.5

[58] Field of Search ..... 75/142, 147; 148/32, 148/32.5, 2, 12.7 A, 11.5 A

[56] References Cited

U.S. PATENT DOCUMENTS

| | | | |
|---|---|---|---|
| 3,418,177 | 12/1968 | Pryor | 148/11.5 A |
| 3,935,007 | 1/1976 | Baba et al. | 148/12.7 A |
| 4,000,007 | 12/1976 | Develay et al. | 148/12.7 A |

*Primary Examiner*—R. Dean

*Attorney, Agent, or Firm*—Robert H. Bachman; Joseph Fleischer; Robert A. Dawson

[57] ABSTRACT

High strength extrudable and readily weldable aluminum base alloys are prepared comprising 0.9–1.5% magnesium, 0.4–0.8% silicon, and 0.9–1.5% copper, which may also include optional elements such as manganese, iron, and chromium, wherein the silicon content must not exceed the sum of 0.58 × magnesium content plus 0.25 × the manganese plus iron contents and the copper content must not exceed the sum of magnesium plus silicon contents. Such alloys display improved retention of strength properties after being subjected to welding conditions.

14 Claims, No Drawings

HIGH STRENGTH ALUMINUM EXTRUSION ALLOY

BACKGROUND OF THE INVENTION

The present invention relates to high strength aluminum base alloys and particularly to wrought high strength aluminum base alloys produced in extruded or hot-rolled plate form, which are well adapted for welding operations in further fabrication steps, wherein the strength properties are retained at high values, even exceeding about 40 ksi for the yield strength of extruded products and 30 ksi for hot rolled plate, without any necessity for interposing special heat treatment steps.

The alloy compositions in accordance with this invention have been shown to meet the specified requirements and have furthermore surprisingly provided excellent solutions to the problems and disadvantages consistently associated with previous attempts to use prior art alloy compositions for such purposes. Such attempts were accompanied by inordinate loss of strength properties on welding, and/or a requirement after welding for special heat treatment and artificial aging steps to recover at least part of the lost strength properties, and/or an excessive tendency to undergo weld failures, such as under-bead weld cracks, and/or susceptibility to various types of corrosion, such as stress corrosion or exfoliation corrosion, which might result in excessive failures in service.

Thus, at least one of the foregoing disadvantages, and usually several of them is encountered in attempts to weld previously known high-strength aluminum base alloys which include magnesium, silicon and copper as essential components, as occurs in such attempted use of AA Alloys 6066 and 6351, and of alloy compositions as disclosed in U.S. Pat. Nos. 3,498,221 and 3,935,007 and in British Pat. No. 1,383,895, also described in Journal of Metals (September, 1976), pages 15–18, which in general were formulated to accomplish purposes differing from the present objectives.

Accordingly, it has been a principal object of the present invention to provide improved high strength aluminum base alloy compositions characterized by the capability of being welded readily without undergoing an excessive decrease in strength properties.

A further object has been the provision of such alloy compositions characterized by the capability of being formed by extrusion or by hot-rolling procedures.

Another object has been the provision of such alloy compositions comprising a defined range of magnesium content in conjunction with other essential elements in proportions required to achieve the desired functional characteristics.

A further object has been the provision of such alloys characterized by heat-treatability and natural aging characteristics.

Another object has been to provide such alloy compositions readily suitable for conversion to wrought products.

Further objects and advantages of the present invention will be apparent from the following detailed description.

SUMMARY OF THE INVENTION

In accordance with the present invention, it has now been found that the above objects can be advantageously obtained by the provision of alloy compositions consisting essentially of 0.9–1.5% magnesium, 0.4–0.8% silicon, and 0.9–1.5% copper, wherein the copper must not exceed the sum of magnesium and silicon, and the silicon must not exceed the sum of 0.58 × percent Mg + 0.25 × percent (Mn + Fe). One or more of the group Cr, Mn, and Fe, is usually present, particularly in extrusion alloys, at a content of about 0.05–0.4% and the balance, other than added elements and usual impurities, is essentially aluminum. The added elements may be one or more of the following at the stated weight percentage ranges: 0.01–0.2 zirconium, 0.01–0.2 titanium, 0.01–0.2 vanadium, 0.01–0.4 cobalt, and 0.01–3.5 nickel. As will be discussed later, such additional elements are beneficial in the strengthening and stabilization of the wrought structure induced by hot working, through the formation of fine dispersed intermetallic precipitates. Other elements may be present as impurities in percentages up to about 0.05% each and totalling less than 0.15%, without adversely affecting the desired properties. In a preferred embodiment, the alloys of the present invention may contain 1.0–1.5% Mg, 0.4–0.7% Si, 1.0–1.5% Cu, and 0.2–0.4% of one or more additive elements selected from the group consisting of Mn, Fe and Cr, and the balance essentially aluminum.

Alloys in accordance with this invention have enabled the attainment in articles, after thermal treatments met in welding, of yield strengths of over 30 or 40 ksi, without requiring processing other than natural aging. This represents a major advance over prior art practices and accomplishments, for example as summarized in Aluminum, Volume 3, American Society for Metals 1967), Chapter 12, especially, pages 407–415. In contrast, temper-rolled sheets of Alloy 5456, the highest strength composition in the non-heat-treatable 5000 series of aluminum alloys display a loss in strength properties after welding to values of yield strength and tensile strength characteristic of annealed metal. While certain heat-treatable Al base alloys could be chosen which displayed better retention of high strength values after welding, these gave rise to other problems and disadvantages such as cracked or otherwise unsatisfactory welds, inadequate corrosion resistance, or the need for special heat treatment procedures.

In order to facilitate a comprehensive study aimed at establishing improved alloy compositions for this purpose, a simulated welding test was developed which would accurately indicate the strength properties resulting on the application of the welding procedure. This was accomplished by forming a single pass edge weld on each face of two plate halves 0.25 inch thick of 6061-T6 aluminum alloy, recording time-temperature curves for measured times up to 90 seconds and at a series of distances on each side of the weld. Hardness, tensile strength and yield strength values, and microstructure were determined for these points. This study established that the effects of low energy (corresponding to single pass) MIG welding (by electric arc under inert gas, using filler wire of alloy 5356 at rates of 15 and 30 inches per minute) could be reproduced by immersing a plate of sample alloy, 0.060 inch thick, in molten salt at 750° F. for 10 seconds and cooling in still air, and high energy welding (corresponding to multi-pass or repair conditions) could be reproduced by treatment in molten salt at 750° F. for 20 seconds.

The above simulated welding test was found to accomplish a loss in hardness and strength properties and a change in microstructure corresponding to the changes determined to occur within a zone about 0.3 to 0.4 inch from the weld bead centerline. Thus, the initial 5.75 percent, molybdenum 0.45 to 0.65 percent, silicon less than 0.75 percent, aluminum 0.05 to 0.12 percent, trace elements less than 1.0 percent total with the remainder essentially iron.

A new strong, tough, low carbon 5 percent chromium alloy has been developed, utilizing nickel as the primary element and molybdenum as a secondary element for strength. In the classical 5 percent chromium alloy (ASTM A 217 Gr. C5), carbon imparts strength. In the new alloy, the loss in strength due to the removal of carbon is restored by the use of nickel and to a lesser degree molybdenum, both of which impart strength due to solid solution hardening. The substitution of nickel and molybdenum for carbon, coupled with the other alloying elements are responsible for the improved characteristics and properties. It was found that a nominal composition of 3 percent nickel and 0.5 percent molybdenum gave the desired properties. The nickel greatly enhances the low temperature impact properties of the alloy and is much superior to ASTM A 217 Gr. C5. It compares favorably in impact properties with some of the alloys in ASTM A 352 at a higher strength level.

In addition to its solid solution strengthening effect, molybdenum also improves the tempering behavior and hardenability. It renders the alloy less susceptible to the detrimental effects which other elements, such as phosphorus, have on impact properties. The tempering behavior is improved with molybdenum, since it stabilizes the carbides. Molybdenum contributes markedly to deep hardening, a property known as hardenability. In this respect, it is second only to carbon. As a consequence, in sections where deep hardening is a controlling factor, it raises the endurance limit (fatigue strength) of steel and enhances other properties controlled by depth hardness. Molybdenum also raises the elevated temperature strength and improves resistance to creep.

Manganese improves the impact properties by combining with the sulfur to form manganese sulfide, thus removing the deliterious effect of sulfur.

To provide sufficient fluidity during casting and for deoxidation, a nominal silicon composition of 0.5 percent was chosen. It should be noted that silicon also provides some solid solution hardening. For good impact properties, the silicon must be kept below 0.75 percent.

Aluminum is added during the melting as a deoxidizer and improves impact properties when present at the 0.05–0.10 percent level. However, to prevent lower impact properties, it must be kept below 0.12 percent.

HEAT TREATMENT

Tensile Properties

The tensile properties shown above represent typical properties which are averages over a number of production heats. These properties were obtained using the chemical composition shown above. Although the tensile properties are a function of tempering temperature, they are relatively unaffected by normalizing treatment. Those shown above were obtained with a double normalizing consisting of a 1900° F. heat treatment for 1 hour per inch of thickness which was air cooled, followed by a 1600° F. heat treatment for 1 hour per inch of thickness which was air cooled. Similar properties can be obtained with a single normalize.

Impact Properties

Although the tensile properties are not appreciably affected by normalizing treatment, the impact properties are markedly affected by both the normalizing and tempering procedures. To obtain maximum impact properties, a double normalizing followed by the appropriate temper must be used.

Utilizing hot stage microscopy techniques and hardness and Charpy impact tests, the normalizing and tempering cycles to obtain the maximum properties have been determined. The first normalizing, which is done at 1900° F., breaks up the as-cast structure and converts it into austenite (See FIGS. 1, 2, and 3). Upon air cooling, the austenite transforms to a strained martensitic phase, known as lath martensite. Its formation is associated with heavy shear deformation during transformation as the material is cooled through the $M_s$–$M_f$ temperature range. During this transformation, small particles, which are probably carbides, have been observed within the lath boundaries. This strained martensite becomes the driving force for the second normalizing at 1600° F., which produces a fine grained recrystallized phase of austenite (See FIG. 4). Upon air cooling, the fine grained austenite transforms to fine grained lath martensite. The second normalizing is then followed by the appropriate temper, usually 1200° F. (See FIG. 5). It must be emphasized that these three temperatures must be selected very carefully. Both normalizing temperatures must be above the upper critical ($Ac_3$), since the structures must be converted to austenite.

The first normalizing must be sufficiently high to provide a driving force for the second normalizing, and the second normalizing must be high enough to convert the martensite to austenite, but not so high as to cause grain growth. The correct temperature for the second normalizing would be just above the upper critical temperature. The appropriate tempering temperature is dictated primarily by the desired tensil properties desired. However, in all cases it must be below the lower critical ($Ac_1$) to avoid reversion to austenite which would produce untempered martensite on cooling. To accommodate production variations in chemistry, an optimum tempering temperature of 1200° F. was selected.

In addition to the double normalizing treatment, to obtain maximum impact properties, several of the alloying elements (carbon, silicon, and aluminum) must be kept within certain maximum limits. To optimize toughness at a given strength level, it is mandatory to maintain the carbon at a minimum level (in the order of 0.04 percent), consistent with strength considerations. by alloying with nickel and molybdenum, the required strength can be obtained at carbon levels down to 0.02 percent. For maximum impact (toughness), carbon must be in the order of 0.04 percent maximum and silicon 0.75 percent maximum.

It is quite clear that a tempered, low carbon martensitic transformation induced substructive, with nickel and molybdenum providing solid solution strengthening, has effectively offset the lowering of carbon and will provide excellent tensile and impact properties. This alloy, with its nominal composition of 5 percent chromium, 3 percent nickel, 0.5 percent molybdenum and manganese, is indeed a remarkable combination of high strength, ductility and toughness as measured by tensile and impact tests. A comparison of the average tensile and impact properties for a number of heats of to 26 ksi in yield strength and from 5 to 22 ksi in tensile strength. Similar values of strength losses also resulted with similar alloys, each containing a small addition of Sn, Cd, Mn, Co, V, or Cr.

This series also included three comparison Al alloys containing Mg, Si, and Cu, in proportions not in accordance with the present invention, which yielded test results similar to the above, as shown in Table I.

TABLE I

| Alloy | Mg | Si | Cu | Al | Initial Y T E | After 10 Secs. At 750° F Y T E |
|---|---|---|---|---|---|---|
| 1 | 0.66% | 0.44% | 0.25% | Bal. | 35-39-12 | 15-21-13 |
| 2 | 0.71 | 0.45 | 1.5 | Bal | 42-52-13 | 25-34-12 |
| 3 | 0.75 | 0.47 | 3.1 | Bal | 49-58-0 | 30-43-10 |

In contrast, the following examples will be seen to substantiate the attainment of the objectives of the present invention by the provision of alloy compositions in accordance therewith.

EXAMPLE I

Alloy A, containing 1.38% Mg, 0.67% Si, 1.41% Cu, 0.39% Mn, balance Al (all percentages being by weight, unless otherwise indicated), tested at —T5 temper, displayed the following tensile properties initially, after 10 seconds at 750° F., after 20 seconds at 750° F., and following natural aging for 2 weeks after each treatment, shown in Table II.

TABLE II

| | Y | T | E |
|---|---|---|---|
| Initial | 41 | 56 | 15 |
| After 10 Seconds at 750° F | 33 | 45 | 13 |
| Then, aged 2 weeks | 37 | 48 | 14 |
| After 20 Seconds at 750° F | 26 | 39 | 14 |
| Then, aged 2 weeks | 33 | 45 | 14 |

Thus, the simulated low energy welding test caused a substantially smaller loss in tensile properties than resulted in the previous tests. Furthermore, natural aging following the high energy test (20 seconds) resulted in restoring much of the lost strength.

EXAMPLE II

Comparison alloys having the following compositions not in accordance with the invention were subjected at —T5 temper to the same tests as used in the previous example.

TABLE III (a)

| Alloy | Mg | Si | Cu | Other | Al |
|---|---|---|---|---|---|
| 4 | 0.50% | 1.03% | 0.02% | .38 Fe, 0.49 Mn, 0.007 Ti, 0.043 Zn | Bal. |
| 5 | 1.35 | 0.68 | 1.53 | 0.41 Mn | Bal. |
| 6 | 1.35 | 0.74 | 0.54 | 0.42 Mn | Bal. |

Test results were as follows:

TABLE III (b)

| Comparison Alloy | Tensile Properties (Y-T-E) Initial | After 10 Secs. at 750° F Immediate | After 10 Secs. at 750° F Aged 2 weeks | After 20 Secs. at 750° F Immediate | After 20 Secs. at 750° F Aged 2 weeks |
|---|---|---|---|---|---|
| 4 | 38-43-12 | 18-26-17 | 21-29-15 | 12-22-21 | 13-23-20 |
| 5 | 33-45-16 | 21-33-17 | 24-35-13 | 14-30-20 | 19-35-19 |
| 6 | 25-35-15 | 18-29-18 | 19-30-18 | 13-25-20 | 12-26-21 |

EXAMPLE III

In contrast, significantly improved test results were obtained with alloys in accordance with the invention, included in Table IV.

TABLE IV (a)

| Alloy | Mg | Si | Cu | Other | Al |
|---|---|---|---|---|---|
| B | 1.35% | 0.64% | 1.45% | 0.42% Fe | Bal. |
| C | 1.00 | 0.77 | 1.44 | 0.42 Fe, 0.38 Mn | Bal. |
| D | 1.41 | 0.59 | 1.45 | 0.18 Cr | Bal. |
| E | 1.01 | 0.67 | 1.47 | 0.41 Fe, 0.19 Cr | Bal. |
| F | 1.35 | 0.74 | 1.47 | 0.39 Fe, 0.38 Mn, 0.19 Cr | Bal. |
| G | 0.96 | 0.76 | 1.41 | 0.78 Mn | Bal. |
| H | 1.35 | 0.58 | 1.41 | 0.14 Zr | Bal. |

TABLE IV (b)

| Alloy | Tensile Properties (Y-T-E) Initial | After 10 Secs. at 750° F Immediate | After 10 Secs. at 750° F Aged 2 weeks | After 20 Secs. at 750° F Immediate | After 20 Secs. at 750° F Aged 2 weeks |
|---|---|---|---|---|---|
| B | 39-53-17 | 35-45-13 | 37-48-13 | 24-36-13 | 31-42-14 |
| C | 48-58-13 | 37-47-12 | 36-47-11 | 27-39-13 | 28-40-12 |
| D | 37-52-16 | 35-45-14 | 36-47-16 | 27-38-15 | 32-44-16 |
| E | 46-57-13 | 37-47-12 | 38-47-12 | 28-38-13 | 28-40-13 |
| F | 44-56-14 | 34-46-12 | 35-47-12 | 24-39-14 | 28-44-14 |
| G | 48-58-13 | 34-45-12 | 38-49-13 | 23-38-14 | 26-41-14 |
| H | 41-53-17 | 32-41-13 | 36-45-13 | 24-36-14 | 29-41-13 |

EXAMPLE IV

Three commercial alloys were selected for direct comparison with alloys in accordance with the invention, yielding test results, as listed in Table V.

TABLE V (a)

| Alloy | Mg | Si | Cu | Mn | Cr | Others | Al |
|---|---|---|---|---|---|---|---|
| 7 (6351) | 0.5% | 1.03% | 0.02% | 0.49% | — | 0.38 Fe | Bal. |
| 8 (7006) | 2.40 | — | — | 0.19 | 0.09 | 4.53 Zn | Bal. |
| 9 (7039) | 2.8 | 0.072 | 0.10 | 0.11 | 0.17 | 4.41 Zn | Bal. |

TABLE V (b)

| Alloy | Initial | Tensile Properties (Y-T-E) After 10 Secs. at 750° F Immediate | After 10 Secs. at 750° F Aged 2 weeks | After 20 Secs. at 750° F Immediate | After 20 Secs. at 750° F Aged 2 weeks |
|---|---|---|---|---|---|
| 7 (6351) | 38-43-12 | 18-26-17 | 21-29-15 | 12-22-21 | 13-23-20 |
| 8 (7006) | 55-63-12 | 21-40-19 | 28-50-18 | 22-42-21 | 30-52-22 |
| 9 (7039) | 57-65-11 | 30-48-16 | 29-49-15 | 23-45-19 | 34-58-18 |

EXAMPLE V

Parallel test results listed in Table VI for three alloys in accordance with the present invention substantiate their significantly superior results.

TABLE VI (a)

| Alloy | Mg | Si | Cu | Other | Al |
|---|---|---|---|---|---|
| J | 1.4% | 0.64% | 1.3% | 0.41% Mn | Bal. |
| K | 0.95 | 0.70 | 1.38 | 0.41 Mn, 0.21 Cr | Bal. |
| A | 1.38 | 0.67 | 1.41 | 0.39 Mn | Bal. |

TABLE VI (b)

| | Tensile Properties (Y-T-E) | | | | |
|---|---|---|---|---|---|
| | | After 10 Secs. at 750° F | | After 20 Secs. at 750° F | |
| Alloy | Initial | Immediate | Aged 2 weeks | Immediate | Aged 2 weeks |
| J | 43–54–18 | 34–43– | 35–44–15 | 24–37–14 | 30–44–15 |
| K | 48–58–13 | 41–50–12 | 40–51–12 | 26–39–13 | 28–41–12 |
| A | 41–56–15 | 33–45–13 | 37–48–14 | 26–39–14 | 33–45–14 |

The comparisons afforded by the above two examples show that preferred alloys in accordance with this invention, after low energy welding and natural aging, are substantially superior to the commercial alloys. After high energy welding and natural aging, the present alloys display over twice the strength of 6351 and have tensile properties comparable to those of alloys 7006 and 7039, but without their operational disadvantages.

EXAMPLE VI

This example substantiates the disadvantageous effects which occur when the silicon is present in the alloy in an excess amount, such as to be greater than can be precipitated as a silicide of magnesium or other metal. The alloys listed in Table VII (a) were prepared as in the preceding examples and the test results are summarized in Table VII (b), the "Initial" values having been measured on samples prepared at T5 temper.

TABLE VII (a)

| Alloy | Mg | Si | Cu | Mn | Al | Excess Si |
|---|---|---|---|---|---|---|
| 10 | 0.95% | 0.56% | 1.46% | — | Bal. | 0.01% |
| 11 | 0.95 | 0.69 | 1.4 | 0.42 | Bal. | 0.04 |
| 12 | 1.00 | 1.00 | 1.45 | 0.44 | Bal. | 0.31 |

TABLE VII (b)

| | Tensile Properties (Y-T-E) | | | | |
|---|---|---|---|---|---|
| | | After 10 Secs. at 750° F | | After 20 Secs. at 750° F | |
| Alloy | Initial | Immediate | Aged 2 weeks | Immediate | Aged 2 weeks |
| 10 | 46–56–15 | 37–45–12 | 37–45–12 | 26–37–13 | 29–38–12 |
| 11 | 50–58–13 | 38–45–10 | 36–45–12 | 27–38–12 | 27–39–12 |
| 12 | 53–60–13 | 35–44–10 | 35–43–12 | 27–39–12 | 28–40–11 |

Thus, the present invention provides aluminum base alloys of high strength, capable of retaining adequate strength after being subjected to operations at elevated temperatures, as in fusion welding processes, corresponding to retained yield strength of about 40 ksi or higher for extruded products or somewhat less for hot rolled plate. Strong crack-free welds are consistently and readily obtainable with the present alloys and they show excellent formability for conversion to products having good resistance to stress corrosion and other corrosive influences. Accordingly, these alloys are well adapted for use in varied commercial fields, as in automotive vehicle bodies and components, such as for tanks and containers.

The above description and specific examples substantiate the attainment of the specified objectives of this invention in accordance with the alloy compositions and preferred treatment procedures set forth. It will be understood by those skilled in the art that various modifications may at times be employed advantageously in the illustrative examples, within the scope of the appended claims.

What is claimed is:

1. An aluminum base alloy of high strength properties having improved weldability, consisting essentially of 0.9–1.5% magnesium, 0.4–0.8% silicon, 0.9–1.5% copper, and from 0.05 to 0.4% of at least one member of the group of elements consisting of manganese, iron, and chromium, up to 0.2% each of zirconium, vanadium, and titanium, up to 0.4% cobalt, and up to 3.5% nickel, and balance aluminum, wherein the copper content does not exceed the sum of the magnesium plus silicon contents and the silicon content does not exceed the sum of 0.58 × magnesium content plus 0.25 × the sum of the manganese and iron contents, said alloy having substantially equal contents of magnesium and of copper.

2. The alloy of claim 1, wherein the magnesium content is 1–1.5%.

3. The alloy of claim 1, wherein the copper content is 1–1.5%.

4. The alloy of claim 1, wherein the silicon content is 0.4–0.7%.

5. The alloy of claim 1, wherein the alloy contains 0.2–0.4% of at least one member of the group consisting of manganese, iron, and chromium.

6. The alloy of claim 1, wherein the alloy contains 1.3–1.5% magnesium, 0.6–0.7% silicon, 1.3–1.5% copper, and 0.2–0.4% manganese.

7. The alloy of claim 1, wherein said alloy has been hot rolled and aged.

8. The alloy of claim 1, wherein said alloy has been hot and cold rolled, annealed and aged.

9. A wrought article of high strength, having improved weldability, prepared from an aluminum base alloy consisting essentially of 0.9–1.5% magnesium, 0.4–0.8% silicon, 0.9–1.5% copper, and from 0.05 to 0.4% of at least one member of the group of elements consisting of manganese, iron, and chromium, up to 0.2% each of zirconium, vanadium, and titanium, up to 0.4% cobalt, and up to 3.5% nickel, and balance aluminum, wherein the copper content does not exceed the sum of the magnesium plus silicon contents and the silicon content does not exceed the sum of 0.58 × magnesium content plus 0.25 × the sum of the manganese and iron contents, said article having substantially equal contents of magnesium and of copper.

10. The article of claim 9, wherein said alloy contains 1–1.5% magnesium, 0.4–0.7% silicon, and 1–1.5% copper.

11. The article of claim 9, wherein said alloy contains 1.3–1.5% magnesium, 0.6–0.7% silicon, 1.3–1.5% copper, and 0.2–0.4% manganese.

12. A method for the preparation of wrought products of high strength properties having improved weldability which comprises:

(a) providing an aluminum base alloy consisting essentially of 0.9–1.5% magnesium, 0.4–0.8% silicon, 0.9–1.5% copper, and from 0.05 to 0.4% of at least one member of the group of elements consisting of manganese, iron, and chromium, up to 0.2% each of zirconium, vanadium, and titanium, up to 0.4% cobalt, and up to 3.5% nickel, and balance aluminum, wherein the copper content does not exceed the sum of the magnesium plus silicon contents and the silicon content does not exceed the sum of 0.58 × magnesium content plus 0.25 × the sum of the manganese and iron contents, said alloy having substantially equal contents of magnesium and of copper;

(b) casting said alloy;

(c) heating said alloy to a homogenizing temperature and thereafter homogenizing said alloy;
(d) working said alloy; and
(e) aging said alloy, whereby said wrought products are capable of plastic deformation to form articles.

13. The method of claim 12, wherein said alloy contains 1–1.5% magnesium, 0.4–0.7% silicon, and 1–1.5% copper.

14. The method of claim 12, wherein said alloy contains 1.3–1.5% magnesium, 0.6–0.7% silicon, 1.3–1.5% copper, and 0.2–0.4% manganese.

* * * * *